US006341888B1

(12) United States Patent
Ekholm et al.

(10) Patent No.: US 6,341,888 B1
(45) Date of Patent: Jan. 29, 2002

(54) APPARATUS FOR INTRODUCTION OF A FIRST FLUID INTO A SECOND FLUID

(75) Inventors: Rolf Ekholm, Karlstad; Peter Wigarthsson, Kil, both of (SE)

(73) Assignee: Kvaerner Pulping, AB, Karlstad (SE)

( * ) Notice: Subject to any disclaimer, the term of this patent is extended or adjusted under 35 U.S.C. 154(b) by 0 days.

(21) Appl. No.: 09/165,362

(22) Filed: Oct. 2, 1998

(30) Foreign Application Priority Data

Oct. 14, 1997 (SE) ..... 9703732
Oct. 27, 1997 (SE) ..... 9703904

(51) Int. Cl.[7] ..... B01F 5/06
(52) U.S. Cl. ..... 366/160.1; 366/167.1; 366/176.2
(58) Field of Search ..... 366/151.1, 152.1, 366/160.1, 162.1, 167.1, 173.1, 173.2, 174.1, 176.1, 176.2, 181.5, 336, 338, 340; 162/57, 243

(56) References Cited

U.S. PATENT DOCUMENTS 45,369 A * 12/1864 Maitland
1,140,548 A * 5/1915 Vogelsand
1,496,345 A * 6/1924 Lichtenthaeler
1,519,371 A * 12/1924 Farnsworth
1,702,373 A * 2/1929 Alexander
1,826,776 A * 10/1931 Gunther
1,848,122 A * 3/1932 Forster
1,992,581 A * 2/1935 Reeder
2,429,297 A * 10/1947 Rudolph
2,516,684 A * 7/1950 Doull et al.
2,563,002 A * 8/1951 Bissell et al.
2,740,616 A * 4/1956 Walden
2,747,844 A * 5/1956 Slayter
2,777,467 A * 1/1957 Powell et al.
2,784,948 A * 3/1957 Pahl et al.
2,951,061 A * 8/1960 Gomory
3,147,717 A * 9/1964 Smith
3,167,305 A * 1/1965 Backx et al.
3,190,618 A * 6/1965 Katzen
3,208,829 A * 9/1965 Terenzi
3,219,483 A * 11/1965 Goos et al.
3,266,437 A * 8/1966 Blackmore et al.
3,307,567 A * 3/1967 Gogarty et al.
3,332,442 A * 7/1967 Reed
3,409,274 A * 11/1968 Lawton
3,475,508 A * 10/1969 King
3,698,430 A * 10/1972 Van Gasselt et al.
3,712,341 A * 1/1973 Constantin et al.
3,734,111 A * 5/1973 McClintock
3,818,938 A * 6/1974 Carson
3,866,886 A * 2/1975 Thorne et al.
4,043,539 A * 8/1977 Gilmer et al.
4,053,142 A * 10/1977 Johannes
4,123,800 A * 10/1978 Mazzei (List continued on next page.)

FOREIGN PATENT DOCUMENTS

FI 92417 7/1994

*Primary Examiner*—Charles E. Cooley
(74) *Attorney, Agent, or Firm*—Dorsey & Whitney LLP

(57) ABSTRACT

A method and apparatus for introduction of a first fluid into a second fluid, that flows in a conduit. A first member with a pass-through canal for said second fluid, is at least partially encircled by a chamber with a wall between the inner part of the chamber and the pass-through canal, and a pressurized source of first fluid which is to be supplied into the chamber. At least one series of apertures is distributed about the periphery of the wall, extending there through, such that the first fluid is introduced through the apertures to be mixed into the second fluid based upon the pressure differential between the pressure in the chamber and the pressure in the pass-through canal. At least a portion of the apertures may be selectively blocked or closed to regulate the flow of the first fluid into the pass-through canal.

29 Claims, 7 Drawing Sheets

U.S. PATENT DOCUMENTS 4,189,243 A * 2/1980 Black
4,398,827 A * 8/1983 Dietrich
4,416,610 A * 11/1983 Gallagher, Jr.
4,474,477 A * 10/1984 Smith et al.
4,761,077 A * 8/1988 Werner
4,789,244 A * 12/1988 Dunton et al.
4,954,147 A * 9/1990 Galgon
5,004,484 A * 4/1991 Stirling et al.
5,131,757 A * 7/1992 Smith
5,333,952 A * 8/1994 Perdue
5,338,113 A * 8/1994 Fissenko
5,366,288 A * 11/1994 Dahllof et al.
5,425,581 A * 6/1995 Palm
5,452,955 A * 9/1995 Lundstrom
5,492,404 A * 2/1996 Smith
5,556,200 A * 9/1996 Ekholm et al.
5,597,236 A * 1/1997 Fasano
5,743,637 A * 4/1998 Ogier
5,793,831 A * 8/1998 Tsiklauri et al.

* cited by examiner

APPARATUS FOR INTRODUCTION OF A FIRST FLUID INTO A SECOND FLUID

CROSS-REFERENCE TO RELATED APPLICATIONS

This application is based upon, and claims priority from, Swedish applications Nos. 9703732-9 filed Oct. 14, 1997 and 9703904-4 filed Oct. 27, 1997, both of which are hereby incorporated by reference.

BACKGROUND OF THE INVENTION

The invention relates to a method and apparatus for introduction of a first fluid into a second fluid, where the second fluid flows in a conduit, and wherein the apparatus includes a first member with a pass-through canal for said second fluid. The first member preferably is arranged to form a section in said conduit, and the apparatus includes one or more chambers that extend around at least a main longitudinal part of the periphery of the pass-through canal. A wall is provided between the inner part of the chamber and the pass-through canal, and means are provided for sustaining a higher pressure in the chamber than in the pass-although canal, the pressure sustaining means for supplying the first fluid to said chamber from a pressurized source.

DESCRIPTION OF THE PRIOR ART

Methods and apparatus of the above mentioned general kind are known from, for example, SE 468 341 and SE 502 393. The apparatus which is described in SE 502 393 is frequently used as a mixer in the bleaching departments of the cellulose industries, for the mixing of steam into a pulp suspension to a increase the temperature of the pulp to a level which is desirable for a certain reaction to occur at a desired rate in a subsequent bleaching step. The apparatus permits a good mixing of steam into the pulp suspension, but it is hard to control the amount of steam that is mixed-in or added for regulation of the temperature, without concurrently decreasing the effectiveness of the mixing step. The mixing-in of steam is conventionally regulated by means of a valve in the steam line to said chamber. When the steam supply is throttled down in order to reduce the rate of mixing-in of the steam, the pressure in the chamber will, however, also decrease, and hence cause a pressure differential between the inner part of the chamber and the pulp suspension in the conduit. This pressure differential will, in turn, result in a decrease in the velocity of the steam, when it enters the pass-through conduit for the pulp, with the further result of a decrease in the penetration of the steam into the pulp suspension.

It is also typical for known apparatus of the kind heretofore described, and the method which is practiced using such apparatus, that the pass-through conduit is made as a thin, ring shaped passage for the second fluid, which is thought to promote a good mixing-in effect. Without deciding on whether this assumption is right or not, or if it possibly is true under certain special conditions, it can, however, be concluded that the construction, in practice, will lead to certain problems. This would probably depend on the fact that the first fluid, when it is injected at a high velocity in the second fluid which flows through the narrow gap, interacts with the constriction body which is arranged in the pass-through conduit and serious vibrations can develop in the apparatus, probably due to resonance phenomena.

Yet another draw-back with known apparatus of the type heretofore mentioned (and the method practiced using such apparatus) is that they are relatively heavy. The total cost of the apparatus will be high, due to the material normally consisting of high quality stainless steel, and the apparatus moreover being relatively hard to manufacture.

SUMMARY OF THE INVENTION

The object of the invention is to provide a method and apparatus, which is not afflicted with the above mentioned limits or draw-backs. More specifically, the present invention is directed to a method and apparatus which provides an effective mixing-in of a first fluid into a second fluid, which enables regulated mixing-in of the first fluid with sustained, good mixing-in of the first and second fluids under a wide range of temperature, pressure and fluid velocity conditions, which is easy to automate to achieve the right mixing-in, which is easy to manufacture and which is easy to assemble. Another positive effect of the present invention is that the method and apparatus develops relatively few vibrations. The invention aims, in principle, to achieve a regulation function for adjustable mixing-in of a first fluid into a second fluid.

BRIEF DESCRIPTION OF THE DRAWINGS

The foregoing objects and advantages of the present invention, together with other objects and advantages which may be achieved by use of the apparatus and by practicing the method, will become more apparent upon reading the following detailed description of the invention in conjunction with the drawings. In the drawings.

DETAILED DESCRIPTION OF THE INVENTION

The principles of the present invention are applicable to the introduction of a first fluid into a second fluid, wherein the fluids may be liquid or gas, or combined phases, and wherein particulate matter may be present. The present invention has particular utility in connection with mixing-in steam into a suspension of cellulose fibres (pulp) in a transport conduit for pulp in the bleaching department of a cellulose mill, to preheat the pulp to a desired temperature which is suitable for a subsequent bleaching step. Thus the invention will be described in the context of mixing-in steam into a pulp suspension for exemplary purposes only, and not for purposes of limitation. Without intending to limit the present invention, it should be understood and appreciated that the principles of the present invention are applicable, for example, for mixing-in other fluids than steam into a second fluid, for example, mixing-in gases, such as oxygen, chlorine, possibly also ozone, or for mixing-in a liquid, such as for example a pH-adjusting liquid, chlorine dioxide or another treatment liquid or dilution liquid into said second fluid, which does not necessarily need to be a pulp suspension.

Figure 1:
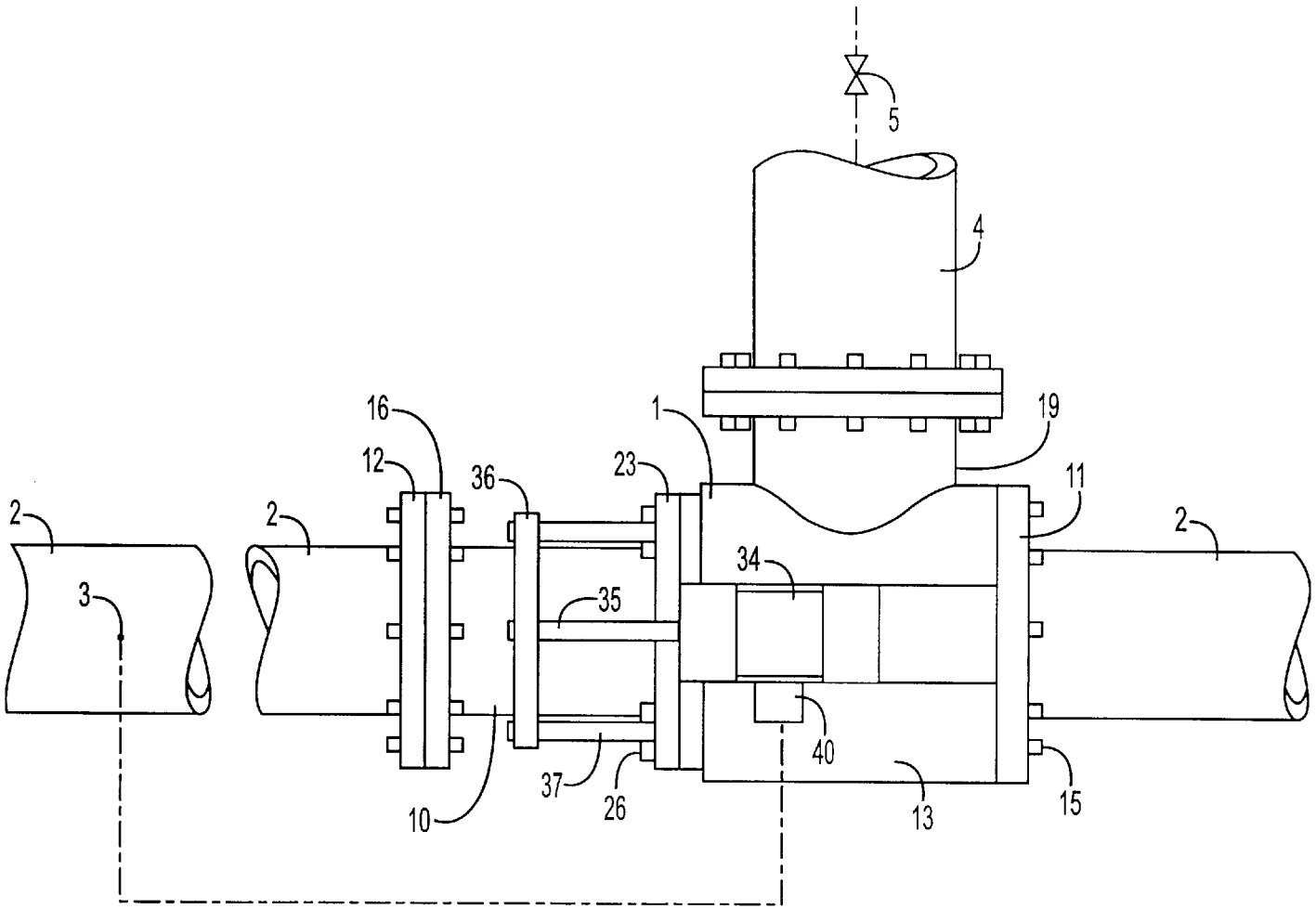
FIG. 1 is a side illustration of an apparatus of the present invention positioned in a conduit and used to practice the method of the present invention.

With reference first to FIG. 1, an apparatus 1 according to the invention is positioned in a conduit 2 (also referred to as a transport conduit) for a second fluid. In the described environment, the second fluid is a pulp suspension, which in the example here described, has a medium high content of fibres, that is "medium consistency, MC", which refers to a dry substance content of 5–20%, preferably 8–16%. The transport conduit 2 extends between an MC-pump to a treatment vessel in a bleaching department, which according to the example could be a peroxide step. The MC and the treatment vessel are conventional and are thus not illustrated in the drawings. The function and method to be performed by the apparatus 1 is to preheat the pulp suspension in the transport conduit 2, with a first fluid, e.g., steam in the described example, to a temperature which is suitable for the bleaching process, for example about 100° C. The transport velocity of the pulp in the conduit 2 is about 15 m/s and the pulp flows generally from right to left in FIG. 1. A temperature sensor 3 is provided in the transport conduit 2 a suitable distance downstream from the apparatus 1. A first fluid, such as pressurized steam in the described embodiment, is provided through a supply conduit 4 from a pressurized source (not illustrated) through a shut-off valve 5 to the apparatus 1. It should be understood that the terms upstream and downstream are used to generally denote the right and left sides of the conduit 2 in the orientation of the apparatus as illustrated in the Figures.

Figure 3:
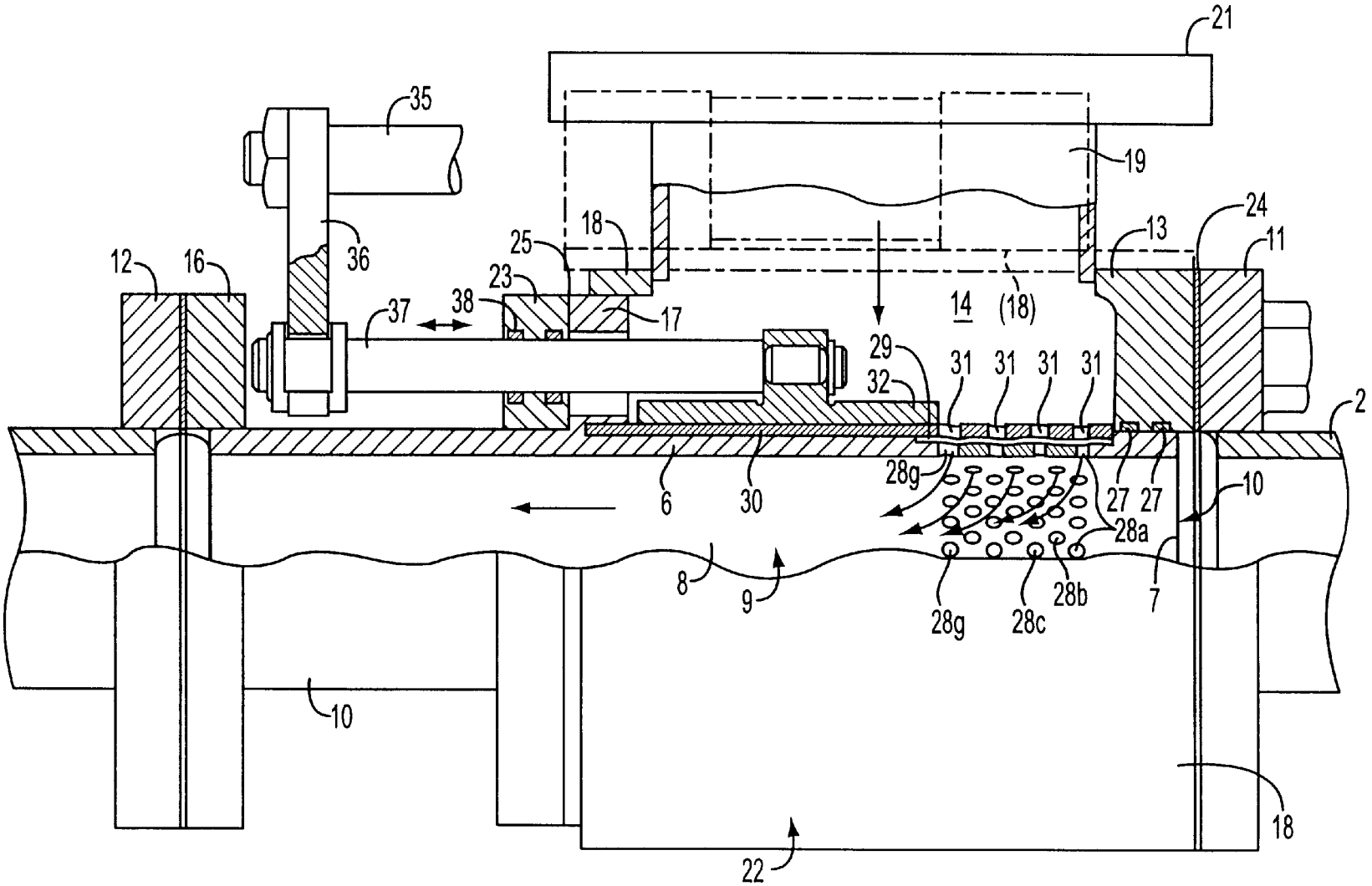
FIG. 3 shows a side view of the above apparatus, partly in cross-section and with certain parts removed for clarity of illustration.

In FIG. 3, tubular body 10 consists of a circular cylindrical, tube shaped member or tubular body, with an upstream inlet opening 7 and a downstream outlet opening 8. The tubular body 10 has a wall 6 with the same inner diameter as the inner diameter of the conduit 2, in which the tubular body 10 is arranged as a section. The interior of the tubular body 10, defined by the inside of the wall 6, forms a pass-through canal 9 between the upstream inlet opening 7 and the downstream outlet opening 8 for the second fluid which is transported in the conduit 2. A first outwardly extending flange 11 is provided for mounting the upstream end of the apparatus 1 to the conduit 2, and a second outwardly extending flange 12 is provided for mounting the downstream end of the apparatus 1 to the conduit 2. The apparatus 1 includes, at the upstream end of the tubular body 10, the first flange 11 which cooperates with an upstream ring end wall 13 in a chamber 14 for steam and includes, at the downstream end of the tubular body 10, a second flange 16 which cooperates with the second flange 12. Preferably the flange 11 and the upstream ring end wall 13 are secured together in a conventional fashion such as by screws and the flanges 12 and 16 are secured together in a conventional fashion such as by screws. In one embodiment, the shortest distance across said pass-through canal 9, in the area of several apertures, between opposite sides of said wall 6 which defines the pass-through canal 9 is between about 50 mm to about 800 mm.

The chamber 14 extends around the central part of the tubular body 10 and is defined by the upstream ring end wall 13, a downstream ring end wall 17 and a cylindrical shell 18. The downstream end wall 17 is joined with the cylindrical shell 18 by means of welding. The upstream end wall 13, the downstream end wall 17 and the cylindrical shell 18 together define or form a housing 22, which holds the surrounding chamber 14. A tubular connection piece 19 extends upwardly from the chamber 14 and includes an outwardly extending flange 21 through which the supply conduit 4 is connected to the tubular connection piece 19 and hence to the chamber 14.

Figure 2:
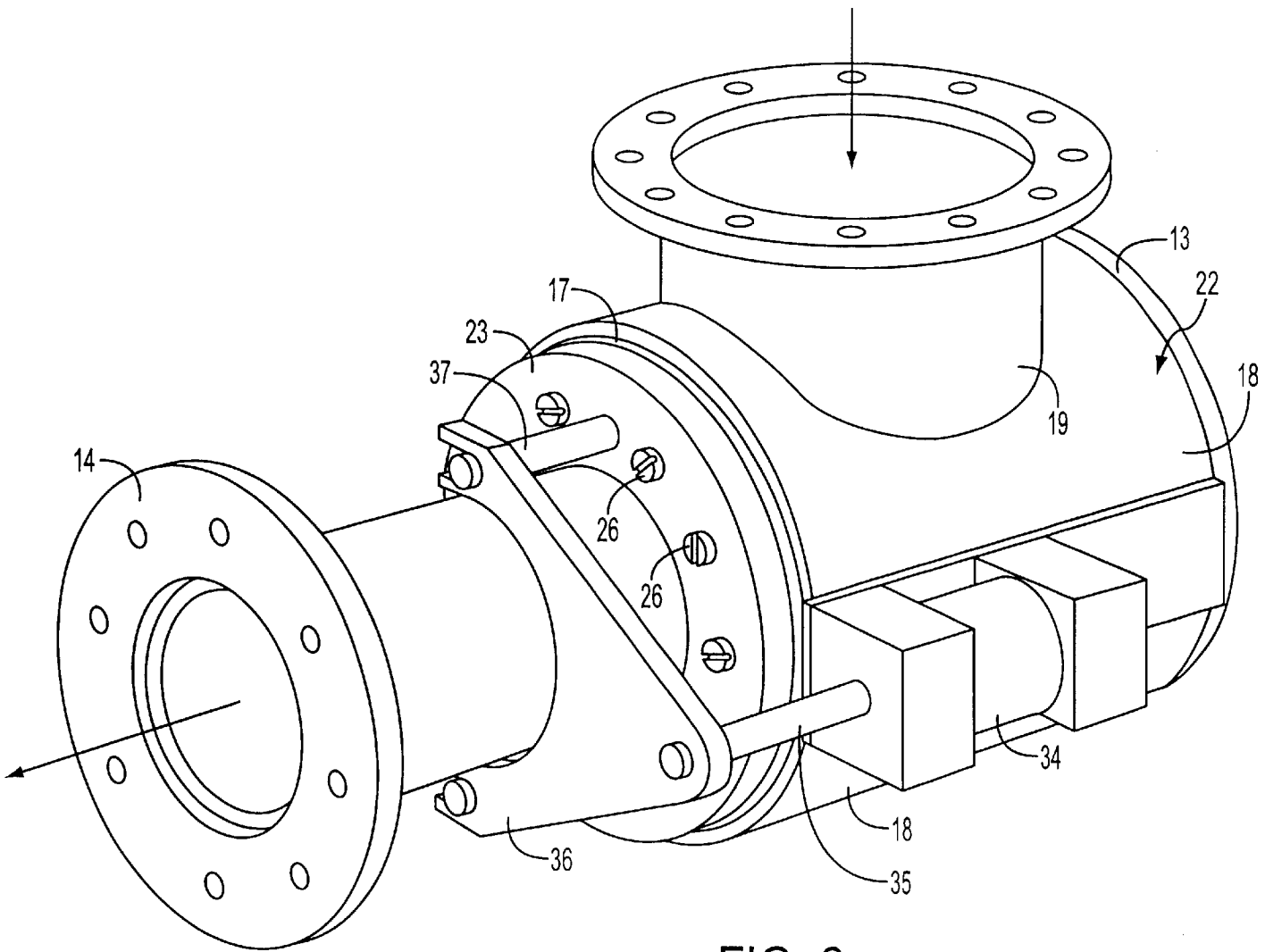
FIG. 2 is a perspective view of the apparatus according to FIG. 1.

As illustrated in FIGS. 1, 2 and 3, a ring 23 is welded at the outside of the tubular body 10, somewhat in front of the middle of the tubular body 10. A housing 22 is, via screws 26, secured to said ring 23, which is welded to the outside of the tubular body 10. Packings or seals 24, 25 are arranged between the first flange 11 and the upstream end wall 13, and between the downstream end wall 17 and the ring 23, respectively and seal rings 27 are provided between the upstream end wall 13 and the tubular body 10 as illustrated in FIG. 3. The ring 23 could therefore also be considered to be a part of the front wall which defines the chamber 14. The housing 22 can be removed from the tubular body 10, when the apparatus 1 is disassembled, after the screws 15 and 26 have been loosened.

The tubular body 10 has, in the present example, an inner diameter of 100 mm. The tubular body 10 has, in the illustrated embodiment, seven series or sets of circular holes or apertures generally denominated 28*a*–28*g*, (although only sets 28*a*, 28*b*, 28*c* and 28*g* have been given reference numerals) and the apertures extend through the wall 6 of the tubular body 10, in the area of the upstream part of the chamber 14. Each of these series or sets of circular holes comprises ten to thirty, which are distributed on the periphery around the tubular body 10. Preferably twenty holes are used for each series or set of circular holes. The center of the holes in each series of holes coincide with a radial plane of the tubular body 10. Each hole has, in the example that is described, a diameter of 8.5 mm, which means that the distance between adjacent holes is less than the diameter of the holes. Adjacent series of holes are circumferentially offset or displaced in relation to each other, so that the holes in a specific series will be placed in the middle between the holes in the next series, that is the center of the holes will lie in the dividing planes between the holes in the adjacent series of holes. The axial distance between adjacent series of holes is also less than the diameter of the holes. The connection lines between holes of adjacent series forms a zigzag line around the periphery of the tubular body. This arrangement provides that the holes, with a total of 20 holes per set×7 sets=140 holes according to the example, will have a distribution which is very close together.

The holes 28*a*–28*g* are covered on the outside of the tubular body 10 with a surrounding wire cloth 29, which prevents fibres from passing through the holes into the steam chamber 14. The exterior of the wire cloth 29 is, in turn, covered on the outside by a case 30, that is provided with a series of generally circular holes 31, which are coaxial with the holes 28*a*–28*g*. On the outside of the case 30, which may be manufactured by bearing metal and which is thus referred to as a bearing case, there is a case formed sealing plate 32, which lies snugly against the bearing case 30. The sealing plate 32 is displaceable between a forward or downstream position, as is shown in FIG. 3, where all of the holes 28*a*–28*g* are exposed and form free passages between the chamber 14 and the inner part of the tubular body 10, to an upstream or rear position, in which all of the holes 28*a*–28*g* are closed by the plate 32. The plate 32 is, however, axially adjustable between the forward and rear positions, thus exposing, for example, one, two, three or all seven series of holes 28*a*–28*g*.

All of the holes 28*a*–28*g* have, according to one non-limiting embodiment, equal diameters. It is, however, also possible that the holes in the different series can have different diameters. The holes 28*a* in the first series or circumferential set, can, for example, be somewhat larger than the holes 28*b* in the second series or set, and the holes 28*c* can be of a different size and/or shape than the preceding series of holes, etc. Certain advantages can, thereby, be achieved in connection with the injection of the first fluid, which will be described later. To control the movement of the sealing plate 32, there is a movement device, such as a pneumatic cylinder 34, on the outside of the apparatus 1, which is illustrated in detail in FIG. 3. The cylinder 34 (FIG. 1) has through rod piston 35 which, via yoke 36 connected with two bars 37, that extend through the ring 23 and the end wall 17 into the chamber 14, where they are joined with the sealing plate 32. Seal rings 38 are arranged in grooves in the ring 23, which seal rings 38 bear on the bars 37 to prevent the leaking of fluid from the chamber 14.

The movement of the piston in the pneumatic cylinder 34 and its positioning in the cylinder is regulated depending on the temperature which is measured in the conduit 2 downstream of the apparatus 1, by means of the temperature sensor 3. The measurement test result is transmitted to an IP-converter 40 to control the positioning of the piston and the through piston rod 35 in a known way, for regulation of the amount of steam which is mixed in, to keep the temperature of the fluid at the adjusted set point. Thus the IP-converter 40 in the described example converts the current from a temperature gauge into pressure which controls movement of the piston. FIG. 3 shows the position of the plate where all holes 28*a*–28*g* are open. There is steam of a certain pressure in the chamber 14. Intermediate pressure steam with a pressure of about 12 bar can, for example, be used. It is, however, also conceivable to use high pressure steam of 17 to 18 bar and in certain cases also low pressure steam. The essential thing is that there is a pressure difference of at least 2 bar between the pressure in the chamber 14 and in the conduit 2 and hence also in the tubular body 10. This pressure difference causes the steam to flow at a very high velocity, through the holes 28*a*–28*g* and to penetrate the pulp suspension that flows through the pass-through canal 9 in the tubular body 10. The steam has a velocity of over 100 m/s and normally up towards or above 200 m/s. It seems to be preferred to use a velocity of close to about one MACH. In connection with the steam penetration into the pulp there normally arises isolated implosions, which, due to their uneven pattern, do not result in vibration resonance. These implosions stimulate, on the contrary, an effective mixing-in of steam into the pulp and hence a good heat transfer, and in applicable cases, a good mixing-in of other gases or liquids.

In this regard it should be noted that a pulp temperature increase of at least 15° C. is desirable in response to the mixing-in of the steam, it being appreciated that conventional steam mixers would not achieve such a temperature increase. Furthermore, it should be appreciated that according to the principles of the present invention, it is contemplated that a temperature increase of about 30° C. may be achieved.

Should the temperature sensor 3 record a temperature which is higher than the set point, it will provide an electrical signal to the IP-converter 40, so that the pneumatic cylinder 34, via the described mechanical transmission, displaces the sealing plate 32 rearwardly, to a position where the sealing plate 32 shields some of the rear series of holes and thereby closes them. Steam continues to be injected into the pulp, through the other holes 28*a*, 28*b*, etc., with a velocity which is unaffected by the change in position of the sealing plate 32. Steam is hence injected into the pulp at a velocity which is the maximum high velocity at the pressure difference between the steam pressure and the pressure in the pass-through canal 9, irrespective of the position of the sealing plate 32.

Another benefit and advantage of the present invention will now be explained. According to the prior art, there is a connection between the pulp line and the steam supply. When the system is first started or activated, pulp must first be supplied and flowing through the conduit before the steam may be supplied and mixed-in. Thus there is a start-up or initial time period where the pressure in the pulp line is greater than the pressure in the steam chamber, which leads to the pulp entering the steam chamber. Fibers in the steam chamber are, of course, undesirable as they lead to problems such as plugging of the moveable parts. The present invention, however, represents a significant improvement in that it permits the steam chamber to be totally sealed from the pulp flow by moving the sealing plate 32 to the upstream position, thus sealing all the holes 28*a*–28*g*. Thus the sealing plate 32 may be considered a sealing plate. This provides the benefit and advantage that the steam pressure can be supplied to the chamber 14 prior to starting the flow of the pulp within tubular body 10 and, as soon as the flow of pulp begins, the sealing plate 32 may be moved to expose the desired number of inlet holes 28*a*–28*g* in order to achieve optimum steam supply.

The injection velocity of the steam into the pulp is dependent upon the size (area, which is a function of shape) of the holes 28*a*–28*g* and the number or quantity of holes. The depth of penetration of the steam into the pulp can, therefore, be somewhat effected. If the area or diameter, for example, of the first series of holes 28*a* is somewhat larger than the area or diameter, for example, of the second series of holes 28*b*, the steam that flows out through the first series of holes 28*a* will have a somewhat larger depth of penetration than the steam that flows out through the next series of holes 28*b*, which should be beneficial for an optimal mixing-in of steam.

Figure 4:
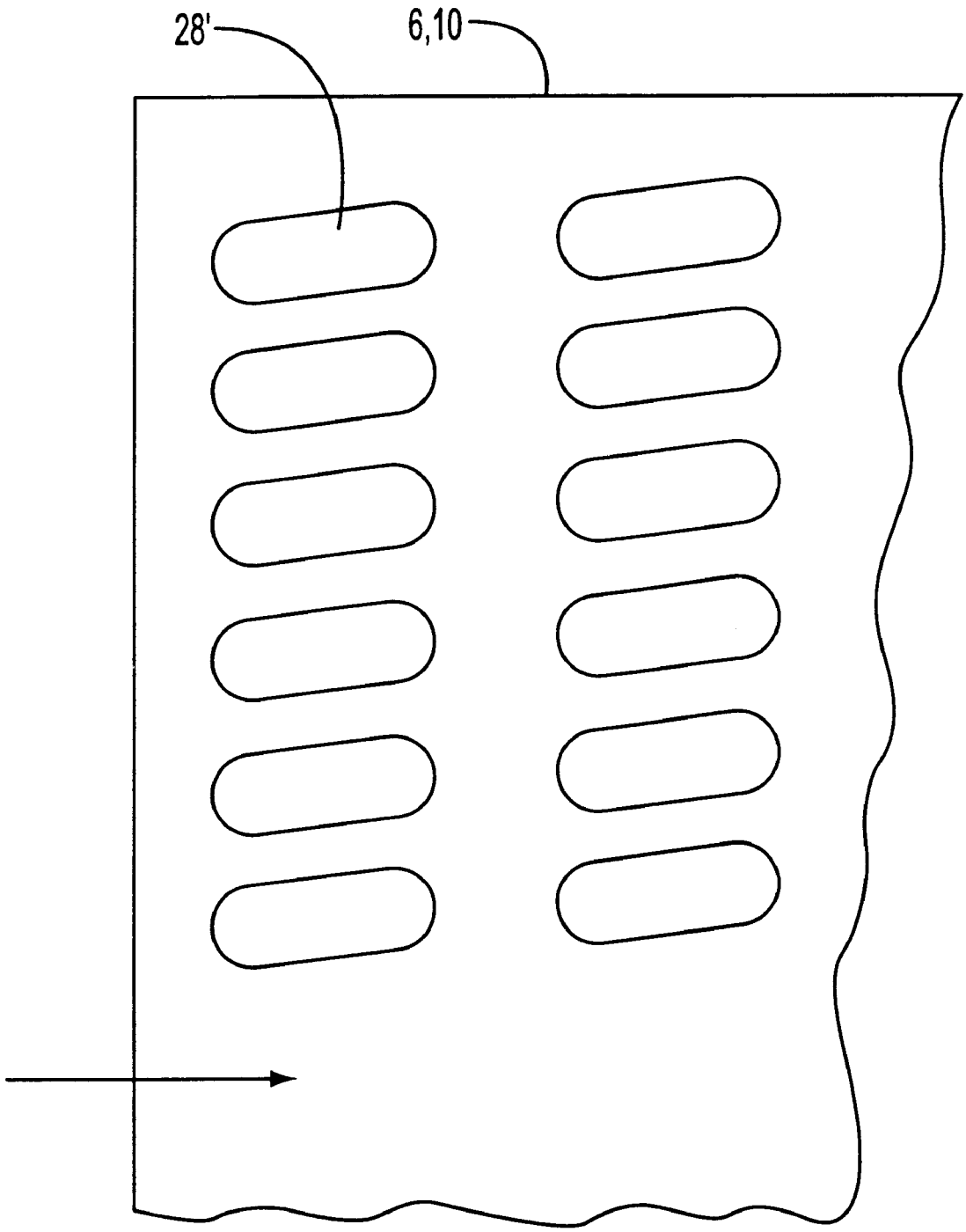
FIG. 4 shows a modified embodiment according to the invention.

With reference next to FIG. 4 there is shown an alternative embodiment of the apertures or holes in the wall 6 of the central first member or tubular body 10. In the embodiment of FIG. 4, the holes, which have been denoted 28', are formed as elongated slots which are rounded at each end and have parallel side walls. The holes 28' are, as in the previously described embodiment, arranged in one or more series, which are preferably evenly distributed around the periphery of the wall 6. FIG. 4 shows a part of the tubular body 10, which is illustrated in planar form for explanatory purposes only. The holes according to the embodiment are, as is shown in this Figure, angled in relation to the longitudinal axis of the pass-through canal 9 and hence to the flow direction of the second fluid. The angle is, according to the embodiment, an acute angle of about 20°–30°. This form of the holes 28' results in the first fluid, which for example can consist of steam, sweeping or scanning over a larger and wider radially exposed flow of the second fluid, which for example consists of a pulp stream to thus obtain an improved distribution of the steam into the pulp. This form of the holes 28' makes the introduction of steam more continuous rather than discrete, i.e., seamless or stepless. The number of holes in each series of holes is suitably between twenty and thirty holes, if the inner diameter of the tubular body 10 is 100 mm, whereby the distance between adjacent holes in each series preferably is less than the width of the holes. In the embodiment of FIG. 4, the upstream side of the tubular body 10 is the left side of the drawing, and the direction of flow of the second fluid (pulp) is in the direction of the arrow.

Figure 5:
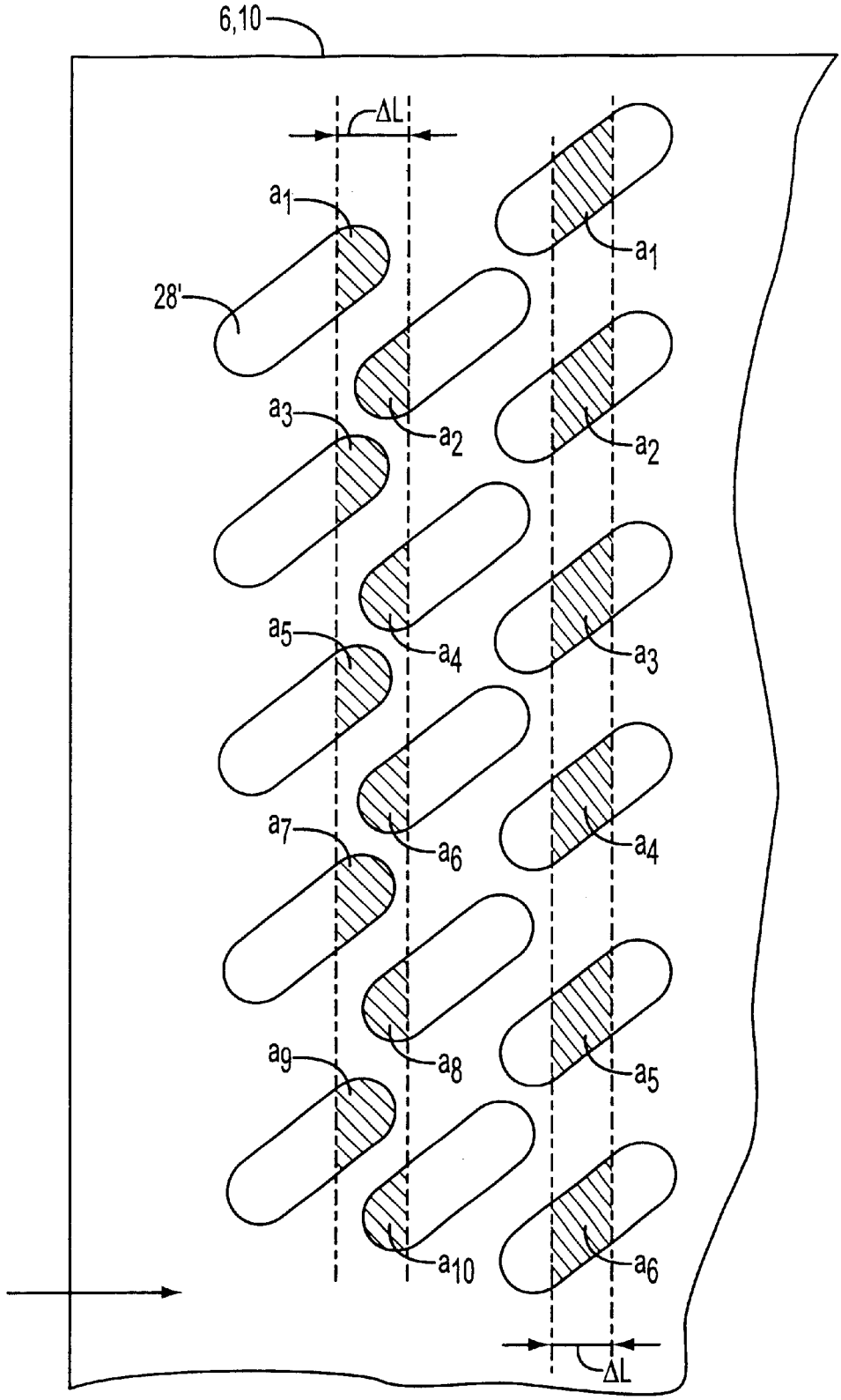
FIG. 5 shows a further modification of the present invention.

FIG. 5 illustrates yet another embodiment of the present invention, again with the direction of flow of the second fluid being illustrated by the direction of the arrow, i.e., from the left to the right in the drawing. The embodiment of FIG. 5 includes circumferential series or rows of elongated slots or holes 28', which are rounded at each end and have parallel side walls, wherein adjacent series of slots are circumferentially offset. Thus the end of each hole in each series of holes extends in between, or overlaps, the ends of the holes in the adjacent series. The holes are this case be formed so that the total open area A in a section of a given length ΔL of the wall 6, in its longitudinal direction, is the same irrespective of where the section is chosen in the part of the wall where the holes are positioned. Moreover, the relation between the length "L" of such a section and the total area A in that section is constant, irrespective of the chosen length AL. This can be expressed as:

$$\Delta L / \Delta A = \text{constant}$$

$$\text{where } \Delta A = a1 + a2 + a3 + \ldots$$

This is of course not true for the first and the last series of holes, which only have an adjacent series of holes on one side. This embodiment achieves a continuous or "stepless" or "seamless" introduction of the first fluid into the second fluid, since the movement of the barrier or sealing plate 32 a certain distance results in a constant, predictable amount of increase (or decrease, depending upon direction of movement) for the area ΔA. Thus "stepless" in this context refers to the absence of discontinuities. Thus the present invention provides, as one feature, that the total open area A of the apertures in a section of a given length "L" is the same, independent of the selection of the location of the length "L", and further that as another feature, the relationship between the length "L" of each section and the total area A will be constant, regardless of the length "L".

Figure 6:
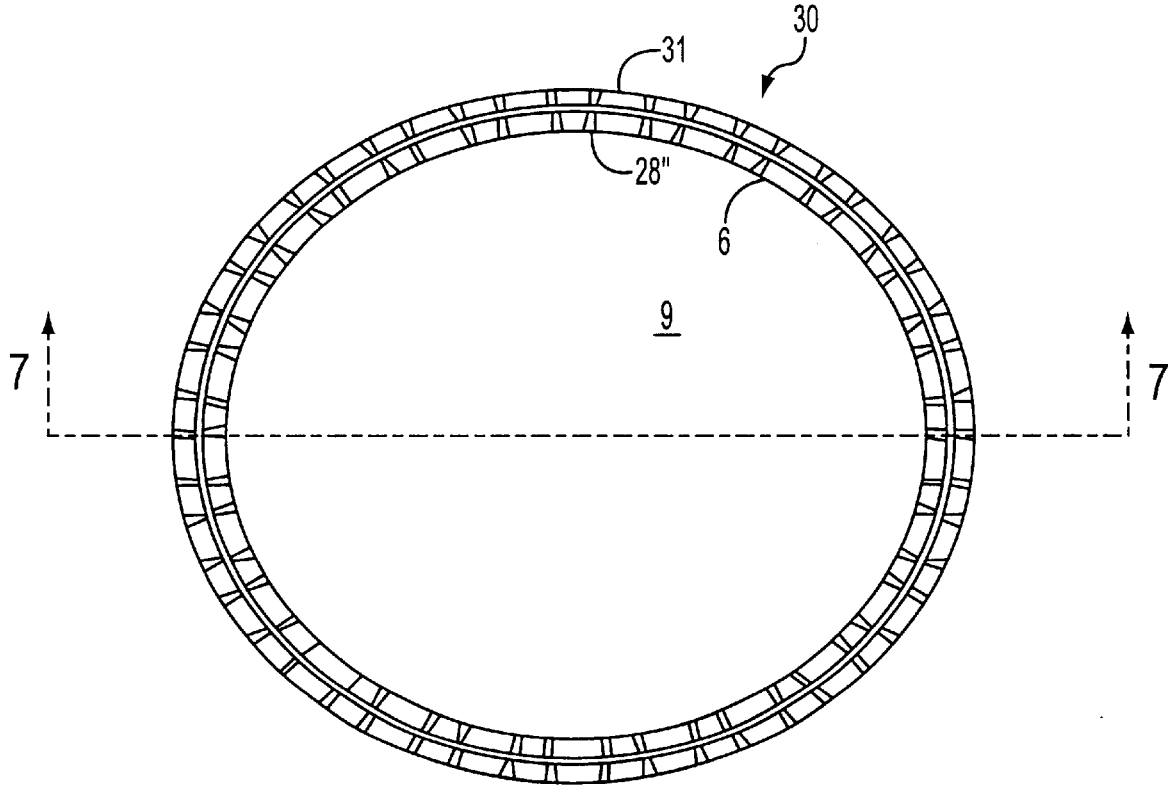
FIG. 6 shows a further modification of the present invention.

With reference next to FIG. 6, another embodiment of the present invention is illustrated, in particular, a single series or row of elongated apertures 28" extends around the periphery or circumference of the tubular body 10. Only one row of apertures is illustrated although it is to be understood that multiple rows of apertures are provided. In the embodiment of FIG. 6, the horizontal axis of each elongated aperture is at an angle of approximately 25°, with each aperture having a length of about 31 mm not including the length of the curved end portions.

Figure 7:
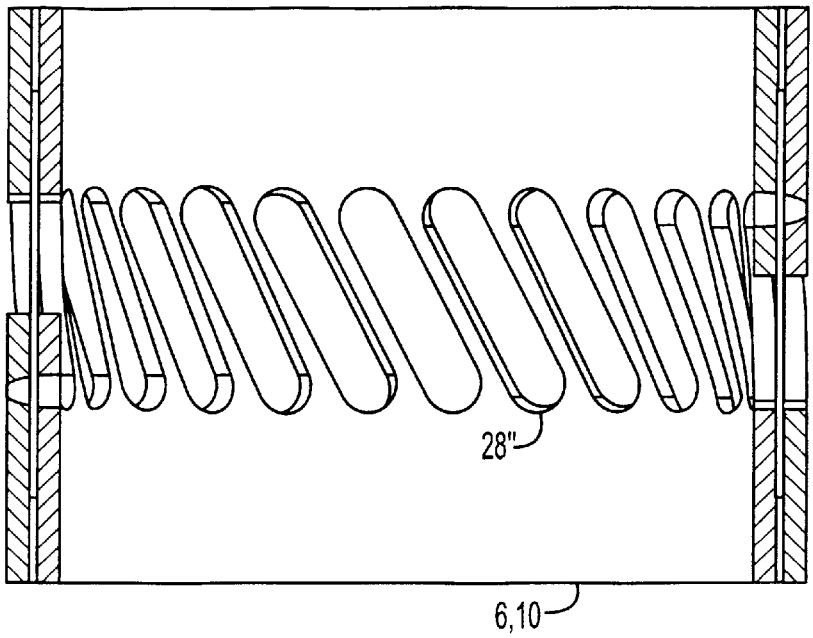
FIG. 7 is a sectional view as seen in the direction of arrows 7—7 of FIG. 6.

FIG. 7 illustrates a sectional view as seen in the direction of arrows 7—7 of FIG. 6. In FIGS. 6 and 7, one series of apertures 28" is illustrated as extending around the circumference or periphery of the tubular body. Movement of the sealing plate 32 (not illustrated in these FIGS.) determines the portion of each aperture which is exposed to allow steam to flow.

Figure 8:
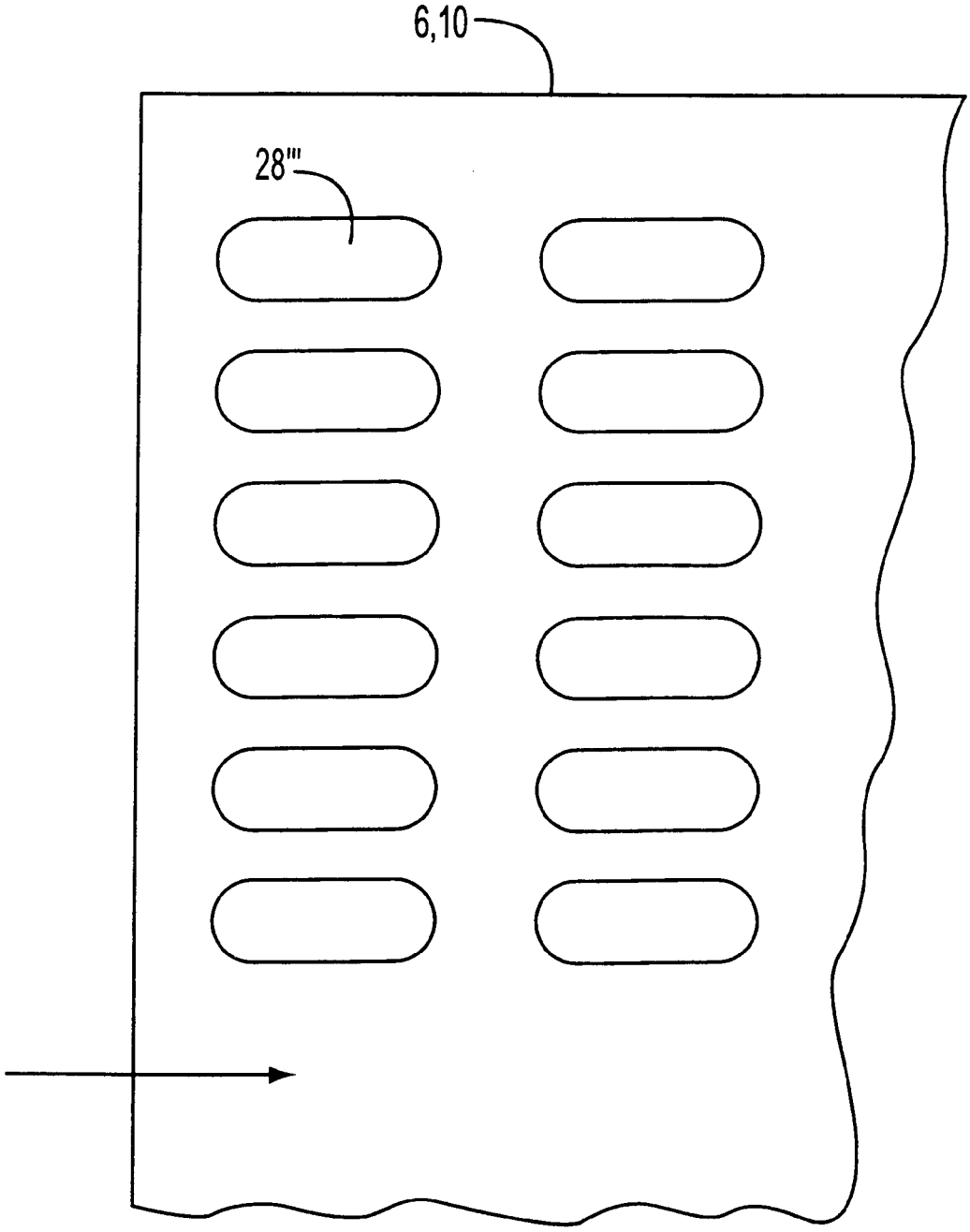
FIG. 8 shows a further modification of the present invention.

With reference to FIG. 8, a further embodiment of the present invention is illustrated, again with the direction of flow of the second fluid being illustrated by the direction of the arrow, i.e., from the left to the right in the drawing. The embodiment of FIG. 8 includes circumferential series or rows of elongated slots or holes 28''' wherein the longitudinal direction of the continuous holes are parallel with the longitudinal axis of the pass-through canal 9.

Thus it should be appreciated that in the various embodiments, the plate or barrier and the apertures (quantity, size and configuration) and the cooperation there between, can each contribute to regulate the volume of the first fluid passing through the wall. The configuration of the apertures may be circular (in cross-section) or noncircular; the apertures in adjacent rows or series may overlap or not overlap; they may be offset radially or aligned radially; they may be uniformly distributed about the periphery; the distance between adjacent apertures may be less than the diameters of the apertures, etc. The combined cross-sectional area of the apertures in one series may be between 7 $mm^2$ to about 320 $mm^2$. The combined cross-sectional area of all apertures may range from a minimum of about 3000 $mm^2$ to a maximum of about 50,000 $mm^2$. The acute angle referred to previously may be from at least 10° to about 80°, although a narrower range such as at least 15° to about 60° is preferred and a range of at least 20° to about 50° may be most preferred. The plate or barrier 32 referred to previously is moveable to shield and/or expose apertures as desired and thus such movement may be used to adjust the velocity of the first fluid flowing through the apertures.

The foregoing is a complete description of the present invention. It has already been mentioned that the fluids to be mixed together can be other fluids than steam and a pulp suspension, whereby it generally is other parameters than the temperature which is to be controlled through regulation of the mixing-in conditions of the first fluid into the second fluid. If, for example, the fluid consists of a compound that is adjusting the pH, the temperature sensor 3 will instead consist of a pH-metering device rather than a temperature sensor which provides an electrical signal which is transmitted to an IP-converter for regulating adjustment of the piston in the cylinder and hence of the adjustment of the sealing plate 32, to make a suitable number of series of holes 28*a*–28*g* exposed or to shield off all of the holes. It shall also be understood that there can be more than one sealing plate 32, and that each such plate can be controlled by a separate movement device. This permits different measurement parameters to be used for regulation of the shielding of the holes. There can further be other patterns for the movement of the sealing plate 32, than strictly axial ones, for example helical movement. Yet another modification relates to the orientation of the apparatus 1. The second medium, the pulp suspension, flows, in the example shown, referring to FIG. 1 and FIG. 3, from right to left. The apparatus 1 can, however, be turned around completely, so that the sealing plate 32 in its completely opened position will be oriented upstream of the holes 31 and 28*a*–28*g*. If the sealing plate 32, from its completely opened position, in this case is moved to a position where any series of holes is covered only partly, the flow of the first fluid through the holes in this series will be throttled, which results in fluid through these holes having a shorter depth of penetration in the second fluid, then the effect would be eliminated by the flow in the flowing holes which are oriented downstream. The present invention, therefore, should be limited only by the scope of the following claims.

What is claimed is:

1. Apparatus for introduction of a first fluid into a second fluid, that flows in a conduit, comprising:

a first member with a pass-through canal for said second fluid;

at least one longitudinally extending chamber that extends around at least a main part of the periphery of the pass-through canal;

a wall between an inner part of the chamber and the pass-through canal;

means for supplying the first fluid to said chamber from a pressurized source for sustaining a higher pressure in the chamber than in the pass-though canal; and at least one series of continuous apertures, each aperture being formed as an elongated slot, having a first rounded end, a second rounded end opposed to the first rounded end, and parallel side walls disposed between the first and second rounded ends, and having a longitudinal axis, each of the apertures extending through said wall, through which the first fluid can be introduced and mixed into the second fluid that flows through said pass-through canal by a pressure differential between a fluid pressure in said chamber and fluid pressure in said pass-through canal.

2. Apparatus according to claim 1 including means for regulating a velocity of the first fluid which passes through said wall.

3. Apparatus according to claim 2 wherein said velocity is regulated by the total cross-sectional area of said apertures.

4. Apparatus according to claim 2 wherein said velocity is regulated by obstructing at least some of said apertures.

5. Apparatus according to claim 2 wherein said velocity is regulated by longitudinal movement of a barrier which obstructs at least some of said apertures.

6. Apparatus according to claim 1, wherein said wall between the chamber and the pass-through canal is a wall in said first member which forms said pass-through canal in the area of the apertures in the wall.

7. Apparatus according to claim 6, wherein said pass-through canal is the inner part of said first member.

8. Apparatus according to claim 1, wherein the pass-through canal is free of any constrictions radially inside of the series of apertures.

9. Apparatus according to claim 1, wherein a plurality of series of apertures are arranged in said wall, each series of apertures being longitudinally spaced apart from the adjacent series of apertures.

10. Apparatus according to claim 1, wherein a plurality of series of apertures are arranged in said wall, the center of the apertures in each series of apertures being offset radially from the center of the apertures in the adjacent series, such that a line connecting the centers of apertures in adjacent series is a zigzag.

11. Apparatus according to any of claims 1–10, wherein the apertures in each series are evenly distributed in the periphery.

12. Apparatus according to any of claims 1–10, wherein the distance between adjacent apertures is less than the diameters of the apertures.

13. Apparatus according to claim 1, wherein a moveable plate is arranged on the outside of the first member in said chamber and a movement device is arranged for longitudinal displacement of said plate to different positions for shielding off and exposing at least a portion of the at least one series of apertures, respectively, against said first fluid in the chamber.

14. Apparatus according to claim 13, wherein said plate is controlled by the temperature in said conduit downstream of the apparatus, for adjusting of the volume of said first fluid which is mixed in, without alteration of the velocity of said first fluid flowing through the apertures, whereby said velocity exceeds 100 m/s and preferably is close to about 1 MACH.

15. Apparatus according to claim 1, wherein the shortest distance, across said pass-through canal, in the area of said apertures, between opposite sides of said wall which defines the pass-through canal is between about 50 to about 800 mm.

16. Apparatus according to claim 1 wherein the apertures in a first series have a combined cross-sectional area of between about 7 to about 320 $mm^2$.

17. Apparatus according to claim 1, wherein the total area of the apertures is at least about 3000$mm^2$.

18. Apparatus according to claim 1, wherein the total area of the apertures is a most about 50,000 $mm^2$.

19. Apparatus according to claim 1, wherein the pass-through canal, in the area of the apertures, has a circular cross-section.

20. Apparatus according to claim 1 wherein the apertures are continuous along the longitudinal axis of the pass-through canal.

21. Apparatus according to claim 20, wherein the longitudinal axis of the continuous apertures forms an acute angle with the longitudinal axis of the pass-through canal in the plane of the wall.

22. Apparatus according to claim 21, wherein the acute angle is between about 10° and 80° in the plane of the wall.

23. Apparatus according to claim 21, wherein the ends of the continuous apertures overlap such that the relation between a length (L) of a section of said pass through canal and a total open area (A) of said continuous apertures in the section is constant, irrespective of the length (L) of the section of said pass-through canal.

24. Apparatus according to claim 1 wherein the longitudinal axis of the continuous apertures is parallel to the longitudinal axis of the pass-through canal.

25. Apparatus according to claim 1, wherein an end of each aperture in the at least one series of continuous apertures extends between ends of apertures in an adjacent series of apertures.

26. Apparatus according to claim 1, wherein the total area of the apertures per unit length of the wall is generally constant along the longitudinal axis of the pass through canal.

27. Apparatus according to claim 1, wherein said first fluid is steam.

28. Apparatus according to claim 27, wherein said second fluid is pulp.

29. Apparatus for introduction of a first fluid into a second fluid, that flows in a conduit, comprising:

a first member with a pass-through canal for said second fluid;

at least one longitudinally extending chamber that extends around at least a main part of the periphery of the pass-through canal;

a wall between an inner part of the chamber and the pass-through canal;

means for supplying the first fluid to said chamber from a pressurized source for sustaining a higher pressure in the chamber than in the pass-though canal; and a first series of apertures, each aperture being formed as an elongated slot having at least one end, wherein the at least one end overlaps with an end of an aperture in a second adjacent series of apertures such that the relation between a length (L) of a section of said pass through canal and a total open area (A) of said apertures in the section is constant, irrespective of the length (L) of the section of the pass-through canal, each of the apertures extending through said wall, through which the first fluid can be introduced and mixed into the second fluid that flows through said pass-through canal by a pressure differential between a fluid pressure in said chamber and fluid pressure in said pass-through canal.

* * * * *